United States Patent [19]

Maddestra et al.

[11] 4,234,148

[45] Nov. 18, 1980

[54] DISPLAY STAND

[75] Inventors: Robert Maddestra, Canton; David E. Munn, Framingham, both of Mass.

[73] Assignee: Damon Corporation, Needham Heights, Mass.

[21] Appl. No.: 4,705

[22] Filed: Jan. 19, 1979

[51] Int. Cl.[2] ..... A45D 19/04; A47G 29/00

[52] U.S. Cl. ..... 248/174; 40/124.1; 40/606; 206/45.19; 211/72; 248/459

[58] Field of Search ..... 211/135, 33, 50, 72, 211/73, 30, 21; 206/45.32, 45.19, 45.14; 40/124.1, 10 R, 606; 229/21; 248/174, 121, 176, 152, 459, 460, 114

[56] References Cited

U.S. PATENT DOCUMENTS

| | | | |
|---|---|---|---|
| 1,936,340 | 11/1933 | Steudel | 211/73 |
| 2,012,498 | 8/1935 | Cohen | 211/33 |
| 2,091,614 | 8/1937 | Powell | 229/21 X |
| 2,425,884 | 8/1947 | Janssen | 5/DIG. 1 |
| 2,480,731 | 8/1949 | Haughwout | 211/33 |
| 2,496,221 | 1/1950 | Koch | 40/124.1 X |

FOREIGN PATENT DOCUMENTS

| | | | |
|---|---|---|---|
| 206977 | 11/1923 | United Kingdom | 211/72 |

*Primary Examiner*—James T. McCall
*Attorney, Agent, or Firm*—Kenway & Jenney

[57] ABSTRACT

Disclosed is a sturdy display stand for holding a relatively small and light in weight article for display. The stand has a platform member supported by a support member. At least one flexible arm extends perpendicularly from the support member and through an aperture in the platform member. The flexible arm is bent so that its free end may be attached to the platform member, thereby creating a pedestal for holding the display article.

10 Claims, 2 Drawing Figures

DISPLAY STAND

BACKGROUND OF THE INVENTION

This invention relates to a display stand and more particularly to a sturdy stand whose parts are cut from thin, stiffly-flexible sheet material.

Display stands for holding objects which are relatively small and light in weight, for example, anatomical models, are known. A representative stand, Model #0101135 manufactured by Eduquip-Macalaster Corporation is constructed of thin, laminated paper stock. The manner in which the three elements of this stand attach to one another in combination with the material used result in a stand lacking durability and sturdiness. In addition, the appearance of the stand detracts from the object being displayed.

It is, therefore, an object of this invention to provide a low cost display stand suitable for construction of a durable sheet material and constructed in such a fashion that the assembled stand is both attractive and sturdy.

It is a further object to provide such a stand having a pair of pedestals for supporting the displayed article.

A still further object is a stand constructed of parts cut from a single, substantially rectangular piece of sheet material with minimal waste.

SUMMARY OF THE INVENTION

A stand for holding an article for display according to the invention is made of few parts: a planar platform member and a support member. The support member attaches to and supports the platform member and also holds the display article. Each part is formed from thin, stiffly-flexible sheet material. Further, the support member advantageously is assembled from two substantially identical and elongate parts. With this arrangement, the three parts, i.e., the platform member and the two support parts, can be formed from a single sheet of substantially rectangular shape and with little waste. Each elongate support part has a base element from which an arm element extends substantially perpendicularly. Each arm element has first and second successive sections with a fold in between, and is located to pass through an aperture in the platform member. Further, the arm element is sufficiently flexible to bend back upon itself and thereby allows the distal end to attach to the platform member, thereby creating a firm and secure pedestal. The two pedestals so formed, i.e., one by each arm element of each support part, are adapted to hold the display article.

In a preferred embodiment, all parts of the display stand are cut from vinyl sheet material. Each support part has a straight lower base edge for continuous contact with the surface on which the display stand rests. The upper edge of the part, parallel to the lower edge, has first and second notched attachment tabs protruding therefrom along with the arm element which creates one pedestal. In this embodiment, the end of each arm element has a notched distal tab for attachment to the platform member. Each support part also has a slot extending perpendicular to the upper and lower edges, and an end tab. This tab fits slidably within the slot of the other part to join the two parts together, thereby forming the support member. Further, the conjoined parts of the support member form a closed path base for supporting the platform member. In this embodiment, the closed path is substantially circular.

The circular platform member of this embodiment has a plurality of arcuate slots for receiving the notched attachment tabs and through which the arm elements of the support members pass. The arcuate slots are sized for stressingly deforming the attachment tabs and the pedestal-forming arm elements, to conform with the arcuate slot geometry, thereby enhancing the stiffness and stability of the stand. In this embodiment, each pedestal-forming arm element has an elongate slot for holding the display article.

These features of the invention result in a particularly sturdy and durable display stand which is both attractive and easy to assemble. The surprising stability of the stand results from elastic deformation both of the base elements and of the pedestal-forming arm elements from their unstressed planar state to a curved conformation of enhanced stiffness.

These and other objects and features of the invention will be better understood from the following detailed description and the accompanying drawing.

DESCRIPTION OF THE PREFERRED EMBODIMENT

Figure 1:
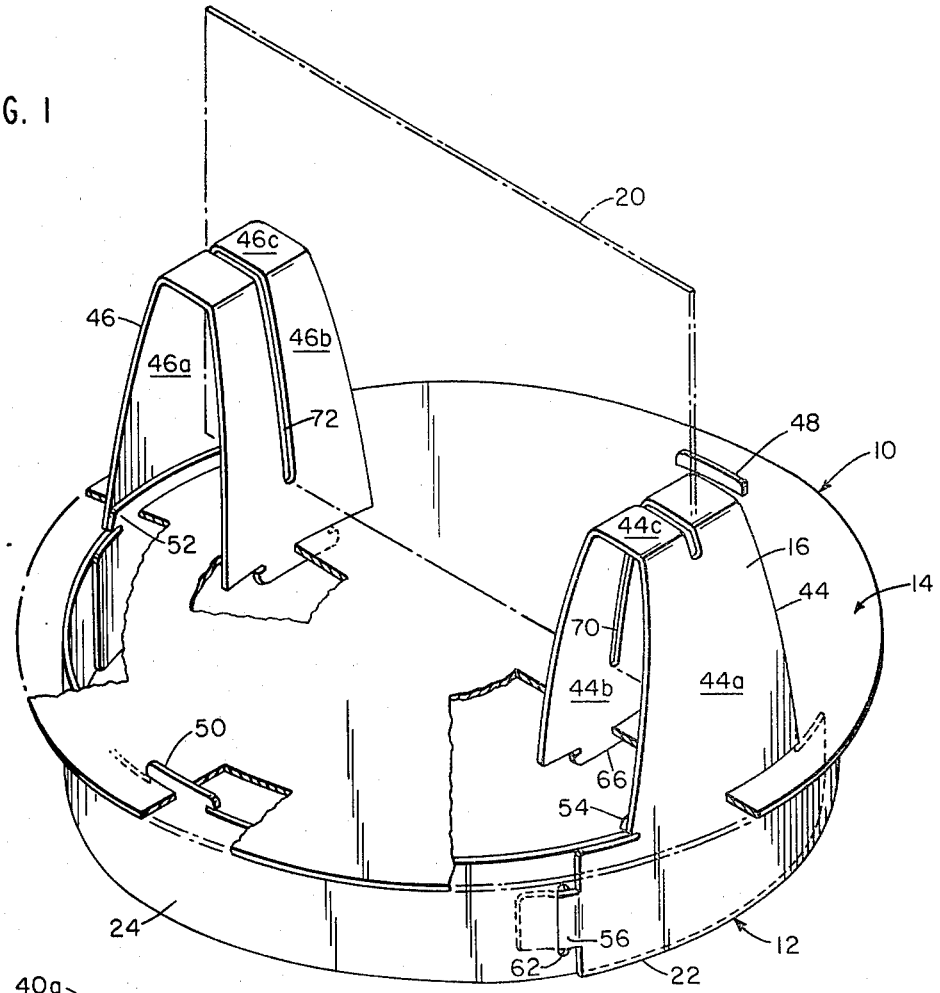
FIG. 1 is a perspective view, partially cut away, of a display stand embodying the invention.
Figure 2:
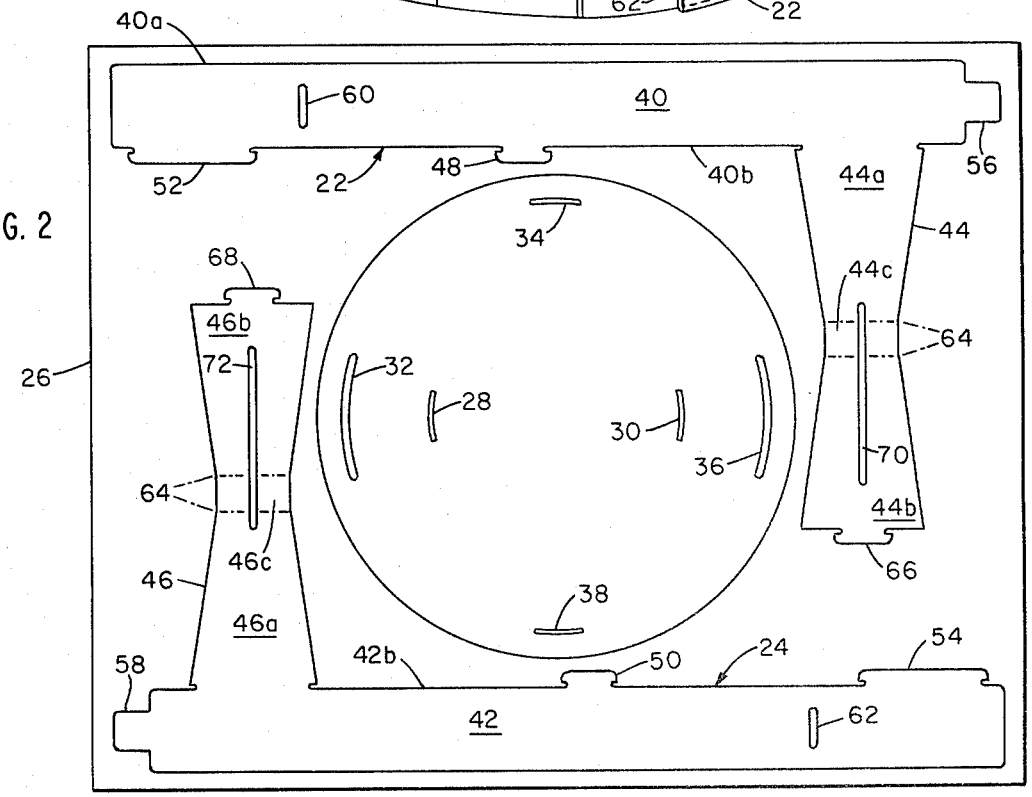
FIG. 2 is a plan view of sheet material from which the display stand parts are cut.

With reference to FIGS. 1 and 2, the illustrated display stand 10 has a support member 12 which carries a platform member 14 and which provides pedestals 16 and 18 projecting above the platform member. An article 20 to be displayed, illustrated simply as a flat card, is caried on the two pedestals. The illustrated support member 12 is assembled from two identical support parts 22 and 24 for the purpose of enabling all three parts, i.e., the platform member 14 and the support parts 22 and 24, to be cut from a single substantially rectangular sheet of material 26 with relatively little waste, as FIG. 2 shows.

The platform member 14 of the illustrated display stand 10 is a flat circular disk apertured with two sets of arcuate slots. One set has two slots 28 and 30 which are diametrically opposite one another and lie along a first circular path. The other set has four arcuate slots 32, 34, 36 and 38 which lie along a larger, second circular path. Slots 32 and 63 are opposite one another along the diametrical line on which slots 28 and 30 lie. The remaining slots 34 and 38 are diametrically opposed along a line transverse to the line along which slots 32, 28, 30, and 36 lie.

Each support part 22, 24 has an elongate base element 40, 42, respectively, from which an arm element 44, 46, respectively, projects. Each base element has a straight lower base edge **40*a*, 42*a*, and an upper edge 40*b*, 42*b* that is straight and parallel thereto except where the arm elements project and where attachment tabs project; hence each base element 40, 42 is essentially in the form of an elongated rectangular strip. Projecting from the upper edge of each base element 40, 42 are a narrow notched attachment tab 48, 50, respectively, and a wide notched attachment tab 52, 54, respectively. In addition, an end tab 56, 58 elongatingly extends from one end of each base element and a slot 60, 62**, respectively, apertures each base element at a location spaced from the other tab-carrying end thereof.

With further reference to the drawings and principally to FIG. 2, each arm element 44, 46 has two successive sections 44*a* and 44*b*, and 46*a* and 46*b*, joined by a bridging section 44*c*, 46*c*, respectively. The junctions of the sections preferably are pre-scored for creasing as indicated with crease lines 64. A notched attachment tab 66, 68 projects from the free end of each arm element 44, 46, respectively. Further, each arm element is apertured with an article-receiving slot 70, 72 which illustratively extends along a major portion of each second arm section, across each bridge section, and along a minor portion of each first arm section, as shown. As also shown, the first and second sections of each arm element are of substantially the same length.

The display stand 10 is assembled from the three parts shown in FIG. 2 by first joining the two support parts together with the end tab 56, 58 of one inserted into the slot 60, 62 of the other to form the support member 12. The conjoined base elements 40 and 42 form a closed circular base for the support member. The platform member 14 is assembled on the support member 12 by inserting the arm elements 44 and 46 through the arcuate, platform-member slots 32 and 36, respectively. The attachment tabs 48, 50, 52, and 54 of the support member are then seated in the second set of platform member slots 32, 34, 36 and 38, to secure the platform member firmly onto the support member. It will now be seen that slots 32 and 36 receive a double thickness of sheet material, whereas the remaining slots receive only a single thickness, and accordingly the former slots are wider than the latter ones. To form the pedestals 16 and 18 and complete the assembly, each arm element is folded back on itself at the crease lines, and the notched attachment tab 66, 68 at the free end thereof locked into a slot 28, 30.

With this construction and assembly, the arcuate slots of the pedestal member deform and thereby stress the tabs and arm elements of the support member in a manner that provides a secure interconnection of the platform member to the support member. Further, the anchorage of the platform member onto the support member resists and prevents the closed-path structure of the support member from circumferentially enlarging and the resulting stress in the interlocked structure enhances the secure engagement of the various tabs in mating arcuate slots.

It will thus be seen that the objects of this invention have been achieved and that the display stand disclosed herein is simple to fabricate and assemble, and is particularly stable and sturdy. Additionally, the component parts are shaped so that they may be cut from a rectangular sheet of material with minimal waste.

It is understood that modifications and variations of the invention described herein will occur to those skilled in the art, and it is intended that such modifications and variations fall within the scope of the appended claims.

What is claimed is:

1. A display stand comprising a platform member of sheet stock material, and a support member of sheet stock material, said support member having a base element disposed below and in supporting engagement with said platform member and having at least one pedestal-forming arm element with first and second successive sections extending laterally from said base element and projecting through an aperture in said platform member, said arm element bending back upon itself between said first and second sections at a location above said platform member, and said second section extending from said bend to an attachment with said platform member.

2. The display stand of claim 1 wherein said aperture is a first arcuate slot adapted for stressingly deforming said first arm section to conform with said arcuate slot geometry.

3. The display stand of claim 1 wherein said attachment of said arm element to said platform member comprises a tab extending from said second arm secton and received within a second arcuate slot in said platform member adapted for stressingly deforming said second arm section to conform with said second arcuate slot geometry.

4. The display stand of claim 1 wherein said base element is stressed to form a closed path below said platform member.

5. The display stand of claim 4 wherein said base element has a plurality of attachment tabs extending laterally therefrom, and wherein said platform member has further arcuate slots located along said closed path and receiving said attachment tabs.

6. The display stand of claim 1 wherein said support member comprises two substantially identical parts, each of which forms part of said base element and has a separate pedestal-forming arm element.

7. The display stand according to claim 4 wherein said closed path is substantially circular.

8. A display stand comprising:

a platform member of sheet stock material and apertured with a plurality of arcuate slots; and a support member of sheet stock material comprising two substantially identical connected parts stressed to form a substantially circular closed path, each said part of said support member having a base element disposed supportingly below said platform member and having a pedestal-forming arm element with first and second successive sections extending laterally from said base element, each said arm elements projecting through a respective first arcuate slot in said platform member adapted for stressingly deforming said first arm section to conform with said arcuate slot;

each said arm element having a fold therein at the junction between said first and second sections and disposed above said platform member;

each said second section extending from said fold to an attachment with said platform member, said attachment comprising a tab extending from said second arm section and seated within a second arcuate slot in said platform member adapted for stressingly deforming said second arm to conform with said second arcuate slot; and wherein a plurality of attachment tabs extend laterally from said base element and are received in further slots of said platform member located along said closed path.

9. The display stand of claim 1 further comprising means forming interlocking secure engagements of said platform member with said support member at both the projection of said arm element through said aperture in said platform member and at said attachment of said second arm element section with said platform member.

10. The display stand of claim 1 further comprising interfitting engagement means attaching said support member with said platform member, said engagement means and the engagements of said arm sections with said platform member at said projection therethrough and at said attachment therewith being arranged for stressingly deforming the engaged elements.

* * * * *